US006401993B1

(12) United States Patent
Andrino

(10) Patent No.: US 6,401,993 B1
(45) Date of Patent: Jun. 11, 2002

(54) MULTI-PURPOSE BOTTLE HOLDER

(76) Inventor: Carlos Andrino, 550 Catalpa Rd., Arcadia, CA (US) 91007

( * ) Notice: Subject to any disclaimer, the term of this patent is extended or adjusted under 35 U.S.C. 154(b) by 3 days.

(21) Appl. No.: 09/722,243

(22) Filed: Nov. 27, 2000

(51) Int. Cl.[7] ..... A45F 5/00

(52) U.S. Cl. ..... 224/148.5; 224/148.6; 224/610; 224/242; 224/251; D3/229

(58) Field of Search ..... 224/148.1, 148.4–148.7, 224/616, 617, 618, 610, 251, 242; D3/229; 248/102, 104

(56) References Cited

U.S. PATENT DOCUMENTS

| | | | | |
|---|---|---|---|---|
| 1,208,728 | A | * | 12/1916 | Bartlett et al. |
| D59,662 | S | * | 11/1921 | Lauzon |
| 1,559,740 | A | * | 11/1925 | Cardarella |
| 4,974,762 | A | * | 12/1990 | Boretsky et al. |
| 5,147,079 | A | * | 9/1992 | Heather |
| D335,957 | S | * | 6/1993 | Cantrell et al. |
| 5,425,485 | A | * | 6/1995 | Carlo |
| D373,677 | S | * | 9/1996 | Kelly |
| D379,119 | S | * | 5/1997 | Wolfe et al. |
| 6,073,796 | A | * | 6/2000 | Mogil |

* cited by examiner

*Primary Examiner*—Gregory M. Vidovich
(74) *Attorney, Agent, or Firm*—Cleveland R. Williams

(57) ABSTRACT

This invention teaches a multi-purpose bottle holder that is suitable for securely transporting water and beverage bottles over long distances or during vigorous exercise programs. The bottle holder can be supported either by an adjustable shoulder strap, or around an individual's waist. The bottle holder comprises an elongated, cylindrical body having a closed bottom and an open top, which define a cavity therein for receiving a bottle. The bottle holder has an expandable front pocket containing a top flap with a securing device. The bottle holder also contains a first securing assembly on one side and a second securing assembly on the other side. The first securing assembly contains a first D-shaped ring and a key holder clasp. The second securing assembly contains a second D-shaped ring. An adjustable strap or belt with two adjustable strips or buckles; elongated O-shaped rings and swivel clasps at either end is attached removably to the first D-shaped ring at one end and to the second D-shaped ring at the other end. A first elastic strap is connected to the first securing assembly and one side of the bottle holder at one end and to an O-shaped ring at the other end. A second elastic strap is attached to the second securing assembly and to the bottle holder on the opposite side of said bottle holder at one end and to the O-shaped ring at the other end. The bottle holder can contain a securing device in the upper inside portion thereof so that the bottle holder, in an alternate mode, can be used as a purse or wallet when it does not contain a bottle.

12 Claims, 3 Drawing Sheets

MULTI-PURPOSE BOTTLE HOLDER

BACKGROUND OF THE INVENTION

1. Field of the Invention

This invention relates to a multi-purpose bottle holder, which is characterized by a circular enclosure that is suitable for holding a bottle. The bottle holder contains an adjustable strap, a key chain holder, external pocket, a retention ring for holding the bottle in place and an open top with securing means therein. In an alternate mode, the bottle holder can substitute as a purse when it does not contain a bottle In the past, individuals that engaged in vigorous exercise programs such as jogging, bicycling and exercising in a physical fitness gym normally had to forego drinking water and other fluids because it was not convenient to carry bottles filled with fluids during such exercise programs.

More recently, bottle holders have been developed which can carry bottles filled with fluids. These bottle holders, however, suffer from the disadvantage of not properly securing the bottle inside the bottle holder and of not providing proper support for the bottle holder on an individual's body during a vigorous exercise program.

Thus, there is a need for a bottle holder that can be easily attached and/or supported by the human body and which can properly secure a bottle inside said holder during vigorous exercise.

2. Description of the Prior Art

Various bottle holders have been utilized in the past to hold and transport bottles and the like over long distances. For example, U.S. Patent 6,004,033 to Cirone relates to a neoprene water bottle holder having a cylindrical configuration containing an attachment mechanism for attaching the water bottle to exercise equipment or other structures. The attachment mechanism is preferably of a hook and loop or magnetic attachment type.

U.S. Pat. No. 5,313,807 to Owens describes an insulated bottle container which is characterized by a flexible enclosure having an inner insulation layer, a stiff bottom to facilitate the container standing upright and provide shock resistance. The neck and body portions of the holder contain elastic to ensure a tight fit around a bottle. A pair of refrigerant pockets is provided in the bottle container to receive frozen refrigerant capsules to provide cooling of a bottle in said container. One or more handles may be attached to the top portion of the container, for carrying purposes.

U.S. Pat. No. Des. 379,119 to Wolfe, et al. shows a design for a bottle holder, which has a cylindrical body with a closed bottom and an open top for receiving a bottle. The bottle holder contains a strap attached to opposite sides of the bottle holder.

U.S. Pat. No. Des. 378,022 to Chen shows a water bottle holder having a cylindrical body with openings at the top and bottom thereof. A strap is attached to opposite sides of the holder and extends downwardly to provide a bottom support for a bottle. The strap also extends upwardly to provide a handle for carrying said bottle holder.

U.S. Pat. No. Des. 269,140 to Holmes shows a combined belt and holder for beverage accessories.

As can readily be determined from the foregoing, there is an ongoing research effort to produce new and novel bottle holders for the easy and efficient transport of water and beverages and other items over long distances.

SUMMARY OF THE INVENTION

The present invention resides in a multi-purpose bottle holder that is suitable for securely transporting bottles of water or beverages attached to an individual's body over long distances.

The bottle holder comprises an elongated, cylindrical body, which has a closed bottom or bottom wall and an open top, defining a cavity therein for receiving a bottle. The bottle holder contains an expandable pocket on the front portion thereof, having a top flap with securing means. The bottle holder also contains first securing means on one side of the holder and second securing means on the other side of the holder. The first securing means contains an upper loop configuration attached to a first D-shaped ring and a lower loop configuration attached to a key chain clasp. The second securing means contains a loop configuration containing a second D-shaped ring. An adjustable strap, with two separate adjustment buckles, is attached at one end to a first elongated, O-shaped ring having swivel means and a clasp and attached at the other end to a second elongated O-shaped ring having swivel means and a clasp. The first and second clasps are removably attached to first and second D-shaped rings. A first elastic strap is attached to one side of the bottle holder and the first securing means at one end and to an O-ring shaped configuration utilizing a loop at the other end. A second elastic strap is attached to the opposite side of the bottle holder and second securing means at one end and to the O-ring shaped configuration utilizing a loop at the other end. The upper inside portion of the bottle holder contains closing and securing means for the top of said bottle holder when it does not contain a bottle.

DETAILED DESCRIPTION OF THE INVENTION

Figure 1:
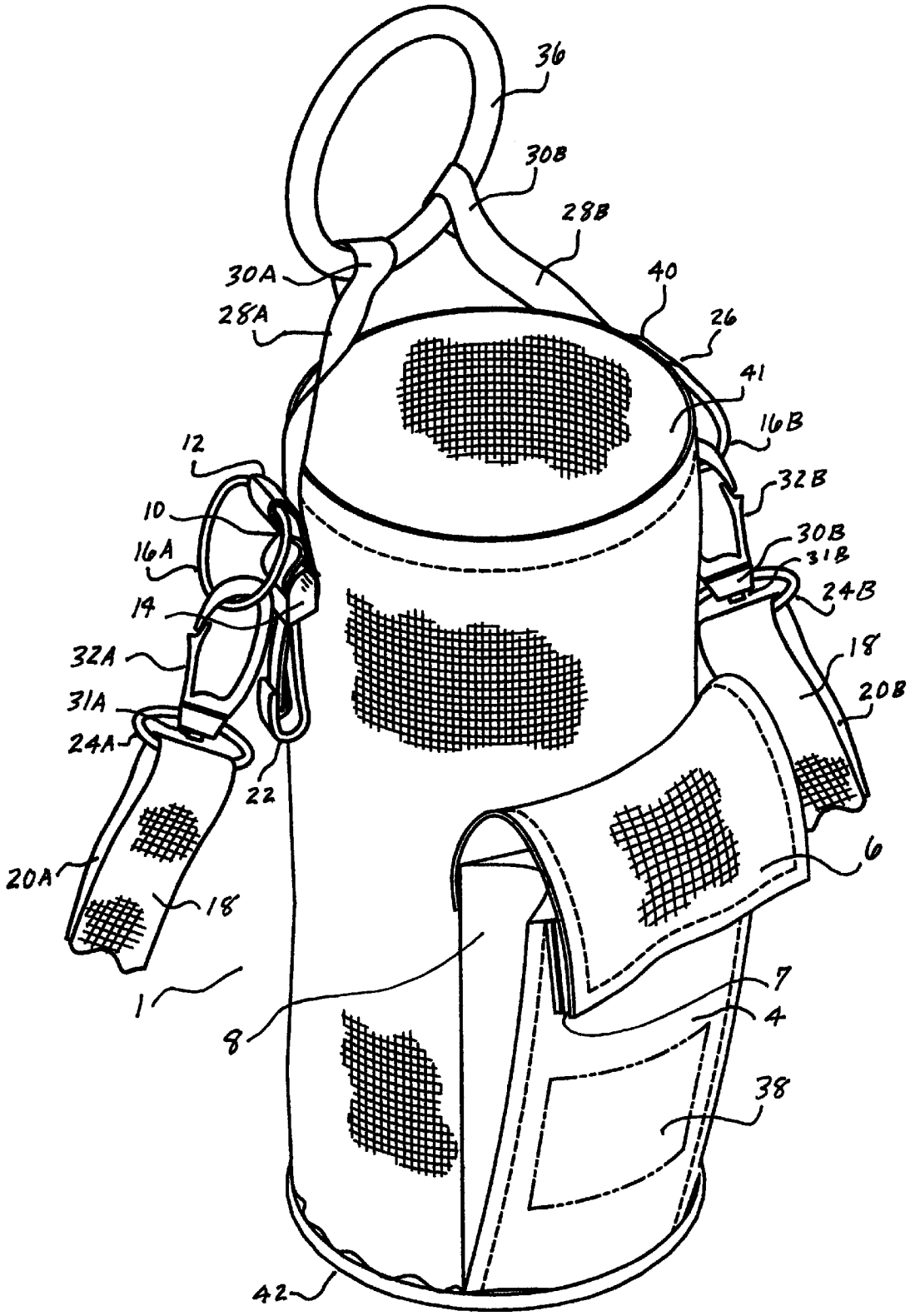
FIG. 1 is a frontal perspective drawing of the bottle holder showing the bottle holder's body, first and second securing means, cut-away view of the adjustable strap, front pocket and top securing O-ring with elastic straps.

The present invention resides in a portable, multi-purpose bottle holder that can be either hand carried or attached to the human body using an adjustable strap. In an alternate embodiment, the bottle holder herein can substitute as a purse when it does not contain a bottle.

Embodiments of the bottle holder of the present invention are hereinafter described with reference to the drawings, in which identical or corresponding parts are indicated by the same reference characters or numbers through the several views.

FIG.'s 1 and 2 illustrate front perspective views of the bottle holder 1 herein.

Multi-purpose, bottle holder 1 comprises an elongated, circular body 2 which has a closed bottom or bottom wall 42 and open top, which define cavity 41. In FIG. 1, elongated, circular body 2 contains front pocket 4 having top flap 6, which is hingably attached to the front of circular body 2 and overlaps the top of front pocket 4. Front pocket 4 contains expandable side wall 8, which allows additional space inside of front pocket 4. The top flap 6 of front pocket 4 is removably secured to the top of front pocket 4 by securing means 7. Securing means 7 is a fastening material sold under the trademarks VELCRO, SCOTCHMATE and MASTEX and is preferably secured on the inside bottom section of the top flap 6 and the outside top section of front pocket 4. Panel 38 located on the front of pocket 4 is reserved for individual and corporate names, slogans, logos and other written indicia that personalizes bottle holder 2. In an alternative mode individual and corporate names, slogans, logos, etc. may be placed on the front of circular body 2 in the space above the top of front pocket 4. A preferred method of placing individualized names, slogans, logos, etc. on the bottle holders herein involves the use of a digitized embroidery machine to impart a professional look thereto.

The elongated circular body 2 of bottle holder 1 contains first securing means 10 attached to one side of the elongated circular body 2 and second securing means 40 attached to the opposite side of elongated circular body 2. First securing means 10 is a strip of material 10 that has a top loop 12 and a bottom loop 14. A D-shaped ring 16A is attached to the upper loop of the strip of material 10 and a key claim clasp 22 is attached to bottom loop 14. Second securing means 40 is a strip of material 40 which has a single loop 26 attached to a D-shaped ring 16B.

Adjustable strap 18 is attached to an elongated, O-shaped ring 24A having swivel means 30A and clasp 32A at one end, and to an elongated, O-shaped ring 24B having swivel means 30B and clasp 32B at the other end. Swivel means 30A and 30B are round structures contained on one side of elongated O-shaped rings 24A and 24B, which have holes centered therein. Clasps 32A and 32B contain elongated, cylindrical shaped shafts 3 1A and 311B, which pass through the holes in swivel means 30A and 30B and are held in place with standard holding means. This configuration allows adjustable strap 18 to swivel 360° around claps 32A and 32B. Clasp 32A is removably attached to D-shaped ring 16A on one side of bottle holder 1 and clasp 32B is removably attached to D-shaped ring 16B on the opposite side of bottle holder 1.

Adjustable strap 18 has adjustment means 20A and 20B, which can be either Velcro™ (hook and loop fasteners) strips attached thereto, or first and second adjustment buckles (not shown) attached thereto.

A first elastic strip of material 28A is attached to one side of bottle holder 1 and first securing means 10 at one end and to O-ring shaped configuration 36 utilizing loop 30A at the other end. A second elastic strip of material 28B is attached to the opposite side of bottle holder 1 and second securing means 40 at one end and to O-ring shaped configuration 36 utilizing loop 30B at the other end. This configuration allows O-ring 36 to be pulled up and over the neck of a bottle 46 contained in cavity 41 of bottle holder 1, e.g. see FIG. 2.

It is to be noted, that the various rings and claps in this invention can be constructed from either plastic, wood or metal, with plastic being preferred. The elastic material herein can be constructed from rubber or a similar material, which allows said material to be stretched without compromising the integrity of the material.

Bottle holder 1 can conveniently be constructed from flexible, pliable materials such as nylon, canvas, cotton or the like. In a preferred mode the bottle holders herein can be constructed from three separate and distinct materials, ie an outer, intermediate, and inner material. The inner, first material is a pliable plastic, vinyl liner or nylon liner which acts as a barrier for water and moisture.

The second, intermediate material is preferably a pliable insulation material, for example a flexible polyolifin, such as polyethylen or a foamed polyurethane, or a closed cell polyethane foam, such as polycarbonate.

The third, outer material is preferably constructed from nylon, canvas, cotton, or synthetic variations thereof. The only restriction is that the outer material be durable under use conditions. The material herein may be connected to each other by sewing, sonic welding, heat transfer, heat welding, etc.

Figure 2:
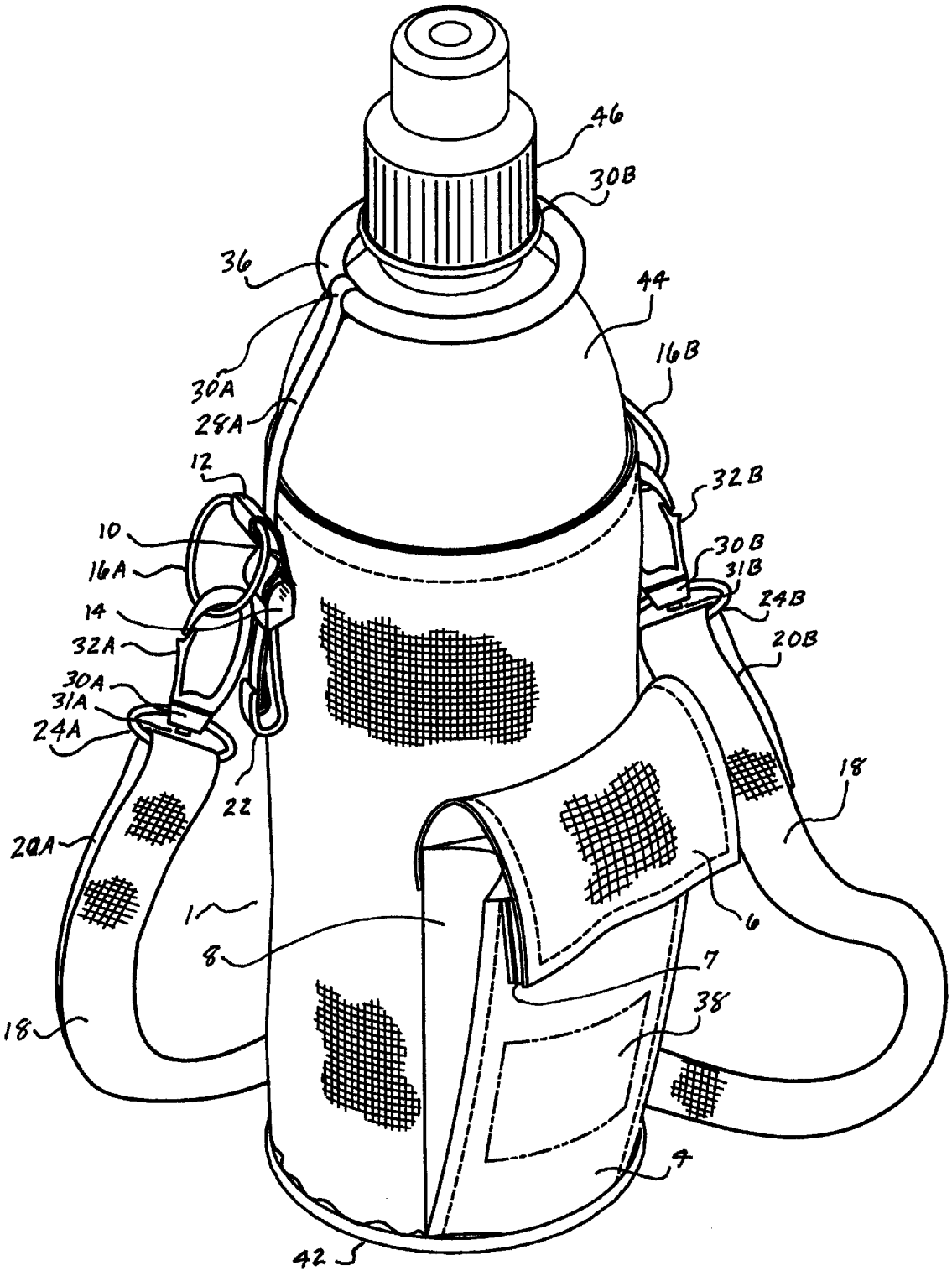
FIG. 2 is another frontal perspective view of the bottle holder of FIG. 1, which contains a bottle in addition to the other above described features.
Figure 3:
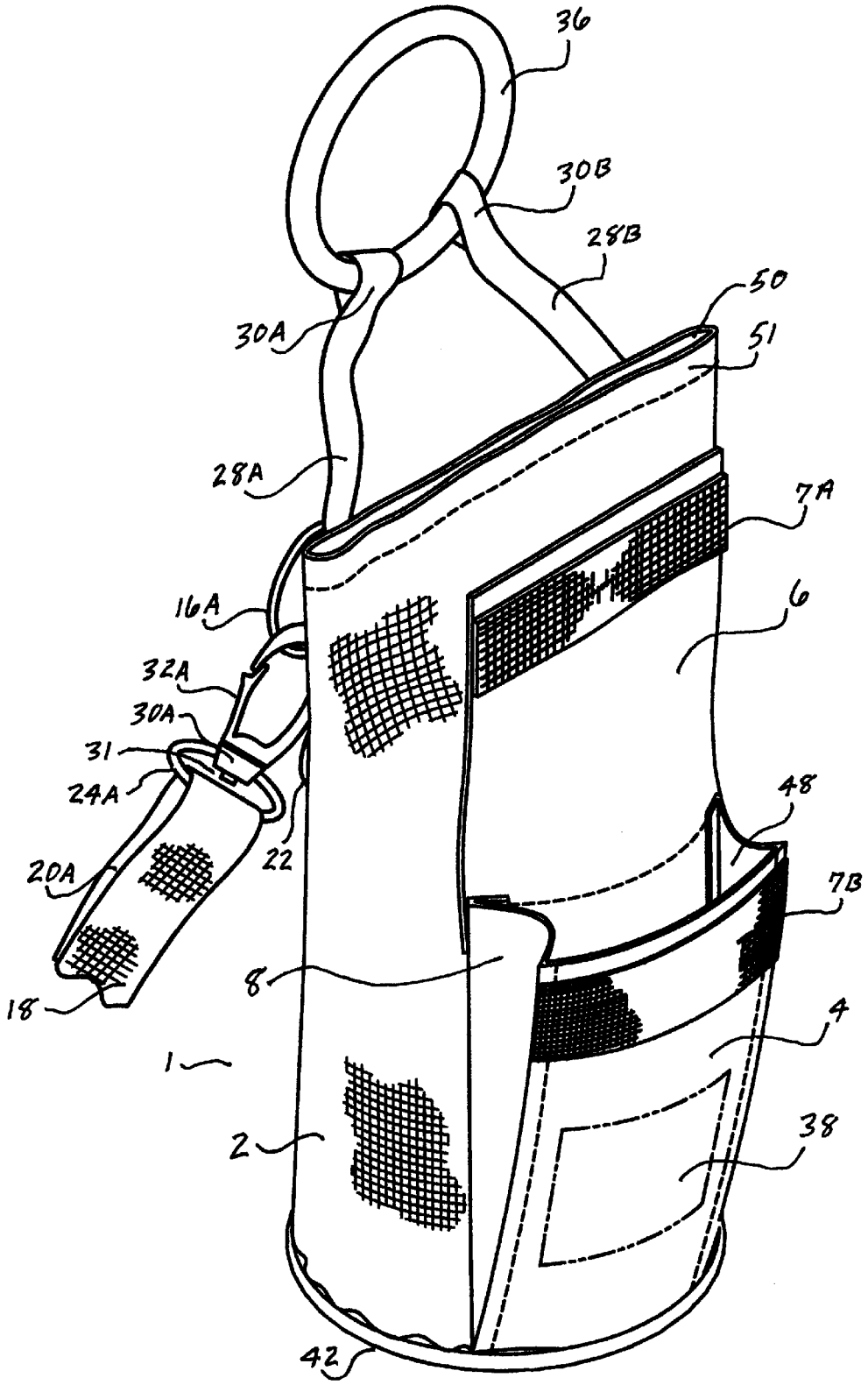
FIG. 3 is a frontal perspective view of the bottle holder of FIG. 1, showing the top of the bottle holder in a closed and secured position.

FIG. 3 is substantially the same as bottle holder 1 in FIGS. 1 and 2 with the following exceptions:

Top flap 6 on front pocket 4 is in an open position and securing means 7A is located on the bottom inside portion of top flap 6 and securing means 7B is located on the top outside portion of front pocket 4. Cavity 48 inside of front pocket 4 is suitable for storing personal items such as credit cards, identification papers, money and the like.

Bottle holder 1 in this figure does not contain a bottle. The top 51 of bottle holder 1 is in a closed position, secured in place with securing means 50, which is substantially the same as securing means 7A and 7B herein. Thus, when not used to hold a bottle, bottle holder 1 can be converted into a purse or pocket book to carry personal items.

It should be also be noted that adjustable strap 18 can be utilized as a shoulder strap to carry bottle holder 1 or adjusted to be used as a belt to carry bottle holder 1 around the waist of an individual.

Obviously, many modifications and variation of the invention, a hereinbefore set forth, may be made without departing from the spirit and scope thereof, and therefore, only such limitations should be imposed as are indicated in the appended Claims.

I claim:

1. A multi-purpose bottle holder which comprises an elongated cylindrical body having a bottom wall and an open top which define a cavity, and containing a front pocket having a top flap, first securing means is attached to one side of the bottle holder and second securing means is attached to the opposite side of the bottle holder, an adjustable strap having swivel means at each end is removably attached to the first securing means at one end and removably attached to the second securing means at the other end; and, a first elastic strap is attached at one end to the first securing means and the one side of the bottle holder, and to an O-ring at the other end, and a second elastic strap is attached to the second securing means at one end and to the O-ring at the other end.

2. The multi-purpose bottle holder of claim 1, wherein the front pocket comprises an expandable front pocket having a top flap with hinge properties and securing means for securing the top flap to the pocket.

3. The multi-purpose bottle holder of claim 1, wherein the first securing means comprises a strip of material attached to the one side of the bottle holder and containing an upper loop and a lower loop.

4. The multi-purpose bottle holder of claim 3 wherein the upper loop contains a D-shaped ring.

5. The multi-purpose bottle holder of claim 3 wherein the lower loop contains a key holder clasp.

6. The multi-purpose bottle holder of claim 1 wherein the second securing means comprises a strip of material attached to the opposite side of the bottle holder containing the first securing means, and having a single loop containing a D-shaped ring.

7. The multi-purpose bottle holder of claim 1, wherein the adjustable strap contains first and second adjustment means for adjusting the length of the strap.

8. The multi-purpose bottle holder of claim 7, wherein the first and second adjustment means comprises a first and second buckle.

9. The multi-purpose bottle holder of claim 1, wherein the adjustable strap contains first and second securing strips.

10. The multi-purpose bottle holder of claim 1, wherein the top portion of the bottle holder has securing means for closing the open top.

11. The multi-purpose bottle holder of claim 1, including an area on the front pocket for personalized indicia.

12. The multi-purpose bottle holder of claim 1, including an area on the cylindrical body for personalized indicia.

* * * * *